United States Patent [19]

Baba et al.

[11] 4,042,400

[45] Aug. 16, 1977

[54] LIGHT-SENSITIVE SILVER HALIDE PHOTOGRAPHIC MATERIAL

[75] Inventors: Shigeji Baba; Bunji Okubo; Eiichi Sakamoto, all of Hino, Japan

[73] Assignee: Konishiroku Photo Industry Co., Ltd., Tokyo, Japan

[21] Appl. No.: 648,743

[22] Filed: Jan. 12, 1976

[30] Foreign Application Priority Data

Jan. 14, 1975 Japan ..... 50-7208

[51] Int. Cl.[2] ..... G03C 1/14

[52] U.S. Cl. ..... 96/124

[58] Field of Search ..... 96/124, 137

[56] References Cited

U.S. PATENT DOCUMENTS

| | | | |
|---|---|---|---|
| 3,793,031 | 2/1974 | Shiba et al. | 96/124 |
| 3,808,008 | 4/1974 | Shiba et al. | 96/124 |
| 3,920,458 | 11/1975 | Shiba et al. | 96/124 |

*Primary Examiner*—J. Travis Brown

[57] ABSTRACT

A light-sensitive silver halide photographic material spectrally sensitized with at least one compound of the formula and at least one compound of the formula wherein $Q_1$, $Q_2$, $Q_3$ and $Q_4$ are individually a non-metal atom grouping necessary to complete an unsubstituted or alkyl-, alkoxyl-, phenyl-, hydroxyl-, carboxyl- or halogen-substituted benzene ring, or a non-metal atom grouping necessary to complete a naphthalene ring; Z is a sulfur or selenium atom; $n_1$, $n_2$, $n_3$ and $n_4$ are individually 2, 3 or 4; $M_1$ and $M_2$ are individually a hydrogen atom, an alkali metal atom or H-Q where Q is an organic base.

5 Claims, No Drawings

LIGHT-SENSITIVE SILVER HALIDE PHOTOGRAPHIC MATERIAL

This invention relates to a light-sensitive silver halide photographic material. More particularly, the invention is concerned with a light-sensitive silver halide photographic material spectrally sensitized with the combination of at least two sensitizing dyes.

As is well known, supersensitization is such treatment that a major proportion of one sensitizing dye is used in combination with a minor proportion of a dye or colorless organic compound different in chemical structure from said dye, thereby further increasing the color speed of photosensitive layer. Sensitizing dyes used in supersensitizing a silver halide photographic emulsion in the whole range of visible spectral region should satisfy such requirements that:

1. they are high in spectral sensitizing synergistic effect,
2. they have sensitizing effect in a pertinent spectral region, and free from deficiency at the green portion,
3. they have no detrimental interactions with other photographic additives, and possess stable photographic properties even during storage of films,
4. they leave no color stain on films after development, and
5. they have no detrimental effect on image quality.

Heretofore, many combinations of two or more sensitizing dyes have been proposed for the supersensitization of silver halide photographic emulsions in the whole range of visible spectral region, but those which completely satisfy the above-mentioned requirements are less in number. That is, some combination forms fog and dye stain when made present together with a residual gelatin derivative, which is formed with an anionic precipitant, while other combination forms fog and color stain when coated on a basic mordant-containing antihalation layer or the like, and, in some cases, brings about even degradation in image quality.

The object of the present invention is to provide a light-sensitive silver halide photographic material which has been supersensitized with sensitizing dyes, which satisfy the aforesaid requirements, do not form any fog and dye stain and are free from deficiency in effect particularly at the green portion in the whole range of visible spectral region, and which has been improved in image quality.

As the result of extensive studies, we have found that when the combination of at least one compound having the below-mentioned general formula (I) with at least one compound having the below-mentioned general formula (II) is added to a silver halide photographic emulsion, there are obtained excellent photographic properties which have not been attained by the conventional processes. That is, we have found that when the combination of said compounds is added to a silver halide photographic emulsion, it is possible to obtain a light-sensitive silver halide photographic material which has been supersensitized over the whole range of visible spectral region, is favorable in storability, is less in color stain after development, and, moreover, has been improved in image quality. General Formula (I)

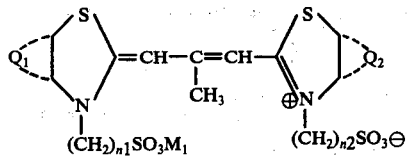

General formula (II)

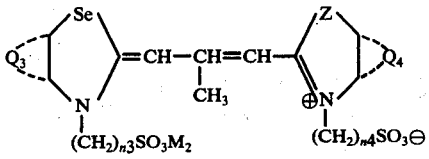

wherein $Q_1$, $Q_2$, $Q_3$ and $Q_4$ are individually a non-metal atom grouping necessary to complete an unsubstituted or alkyl-, alkoxyl-, phenyl-, hydroxyl-, carboxy- or halogen-substituted benzene ring, or a non-metal atom grouping necessary to complete a naphthalene ring; Z is a sulfur or selenium atom; $n_1$, $n_2$, $n_3$ and $n_4$ are individually 2, 3 or 4; and $M_1$ and $M_2$ are individually a hydrogen atom, an alkali metal atom or H-Q (where Q is an organic base, for example, pyridine, triethylamine, etc.).

Typical examples of the compounds having the aforesaid general formulas (I) and (II) are enumerated below, but compounds usable in the present invention are not limited to these. Typical examples of the compound having the general formula (I):

(I-1)

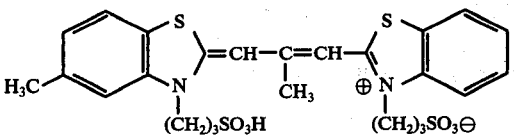

(I-2)

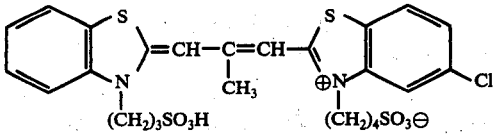

(I-3)

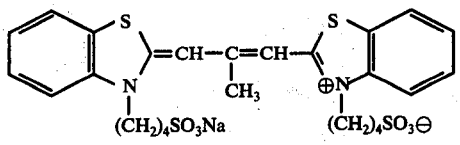

-continued
(I-4)
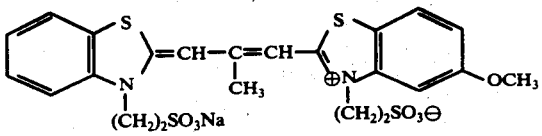
(I-5)
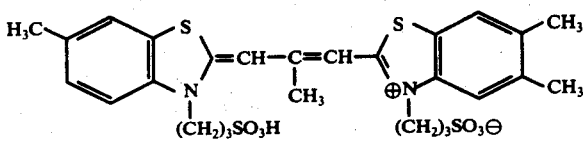
(I-6)
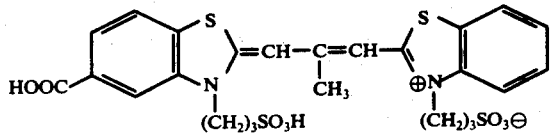
(I-7)
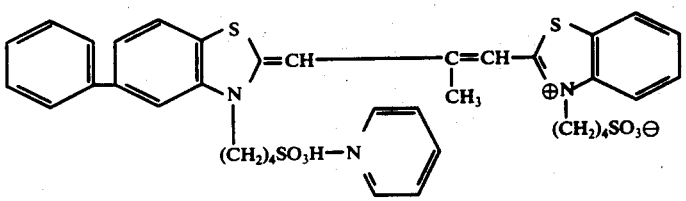
(I-8)
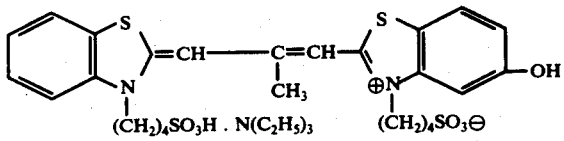
(I-9)
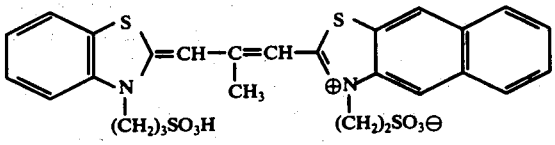
(I-10)
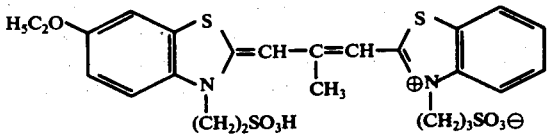
(I-11)
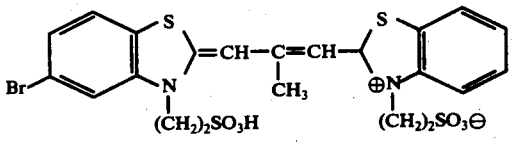
Typical examples of the compound having the general formula (II):
(II-1)
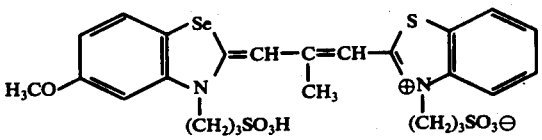
(II-2)
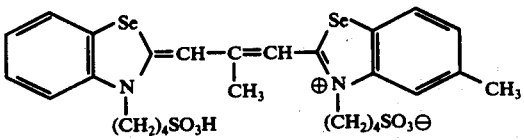
-continued
(II-3)
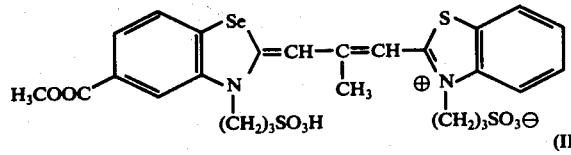
(II-4)
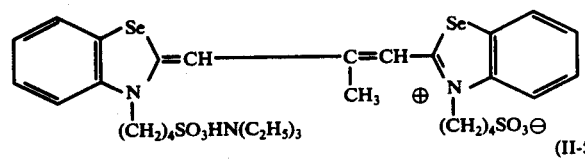
(II-5)

-continued

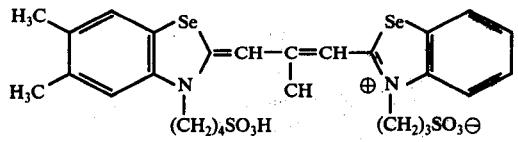

(II-6)

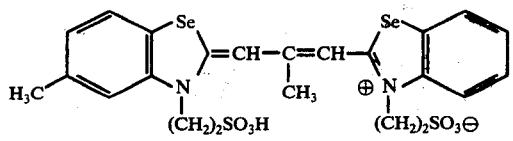

(II-7)

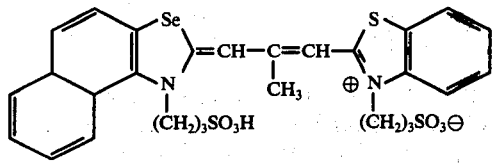

(II-8)

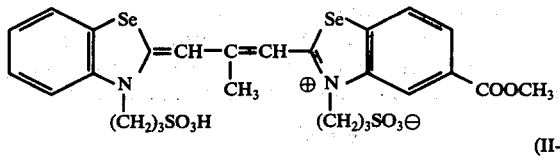

(II-9)

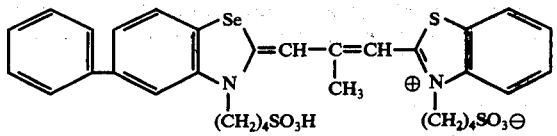

(II-10)

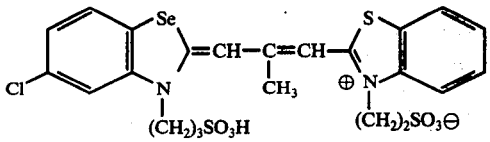

(II-11)

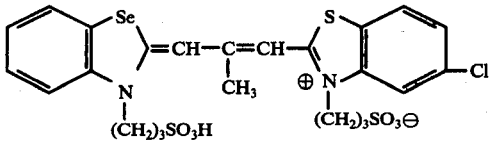

(II-12)

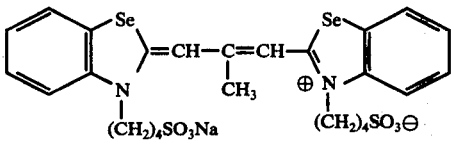

The compounds having the aforesaid general formulas (I) and (II), of course, show spectral sensitizing ability even when used independently. When used independently, however, they are not sufficient in sensitizing ability, are deficient in effect at the green spectral portion, and show no sufficient efficiency when viewed from the standpoint of image quality. If the dyes are increased in amount, not only the dye stain after development increases but also there is brought about such undesirable effect as desensitization or inferior storability. By the combination use of the compounds having the general formulas (I) and (II) which cannot give any sufficient effect when used independently, excellent sensitizing ability, optimum spectral sensitivity and good image quality can successfully be displayed. Such synergistic effect derived from the combination use of the two compounds has been entirely unexpected.

Each of the two compounds used in combination in the present invention has such characteristics that the two nitrogen atoms constituting heterocyclic rings have sulfoalkyl groups as substituents, and the carbon atom at the center of the trimethine chain (at the meso-position) has a methyl group as a substituent. If the compounds fail to have any of said characteristics, no such supersensitization effect as in the present invention can be attained. The combination of the dyes according to the present invention supersensitizes a light-sensitive silver halide emulsion and gives a desirable a spectral sensitivity to the emulsion. Accordingly, the supersensitization according to the present invention is effectively applicable to all photographic materials including not only ordinary photographic materials but also high speed photographic materials, and is particularly useful for application to specific photographic materials such as microfilms, since the compounds used are free from deficiency in effect at the green portion.

The compounds used in the present invention may be added in the form of a solution in water, a water-miscible organic solvent such as methanol or the like, or a mixture of said organic solvent with water. The said compounds can be added to a silver halide emulsion at any stage during preparation of the emulsion. Generally, however, the compounds are preferably added immediately after completion of second ripening. The amounts of the compounds to be added vary depending on the kind and particle size of silver halide. Ordinarily, however, the total amount of the compounds having the general formulas (I) and (II) is in the range from 100 to 1,000 mg. per mole of silver halide, though this is not limitative. At the time of addition to the emulsion, the compounds may be used either separately or in the form of a mixture. The silver halide emulsion used in the present invention may be any of silver iodobromide, silver chloride, silver chlorobromide and silver chloroidobromide emulsions. Further, the emulsion may be subjected to noble metal sensitization using a gold salt, a palladium salt, a platinum salt or the like, sulfur sensitization using a sulfur-containing compound such as sodium thiosulfate, sensitization using an amine type compound or sensitization using a polyalkylene oxide type compound, and may contain an organic or inorganic hardener such as formaldehyde, mucochloric acid, glyoxal or chromium alum. Further, the emulsion may contain an surfactant such as saponin, sodium alkylbenzenesulfonate or the like as a coating aid. It is needless to say that the emulsion may be incorporated with other known photographic additives.

As the support for the light-sensitive silver halide photographic material of the present invention, there may be used a cellulose acetate, polystyrene, polycarbonate, polyethylene terephthalate or the like high polymer film, a glass plate or the like.

The present invention is illustrated in detail below with reference to examples, but the invention is not limited to the examples.

EXAMPLE 1

A medium speed silver iodobromide emulsion for microfilm containing 2 moles% of silver iodide and containing 150 g. of gelatin per mole of silver halide was subjected to second ripening with gold sensitization and sulfur sensitization. After completion of the second ripening, the compounds having the aforesaid general formulas (I) and (II), each in the form of a 0.2% methanol solution, were added to the emulsion. The amount of each compound, per mole of silver halide, was as shown in Table 1. Thereafter, the emulsion was incorporated with fixed amounts of a stabilizer, a hardener and a spreading agent. This emulsion was coated on a subbed cellulose triacetate base to a coated silver amount of 22 mg. per 100 cm², and then dried to prepare a sample.

Samples prepared in the above manner were individually developed at 27° C. for 2 minutes with a developer of the composition shown below, subjected to ordinary fixing and water-washing, dried and then measured in speed to obtain such results as shown in Table 1. In Table 1, the speed is a relative value measured when the white light speed of the sample containing 300 mg/mole silver halide of the compound (I-10) was assumed as 100. Further, the measurement of spectral speed such as sensitivity maximum and sensitivity limit was effected by use of a grating spectrophotometer (manufactured by Shimazu Seisakusho Co., Ltd.).

| Composition of developer: | |
|---|---|
| Metol | 1 g. |
| Sodium sulfite | 75 g. |
| Hydroquinone | 9 g. |
| Sodium carbonate | 27 g. |
| Potassium bromide | 5 g. |
| Water to make | 1,000ml. |

Table 1

| Sample No. | Compound and amount (mg/mole silver halide) Compound (I) | Compound (II) | Relative speed White light speed | Green light speed | Red light speed | Sensitivity maximum (nm) | Fog |
|---|---|---|---|---|---|---|---|
| 1 | (I-10) 300 mg | — | 100 | 7 | 4 | 635 | 0.03 |
| 2 | (I-10) 500 mg | — | 115 | 9 | 7 | 635 | 0.03 |
| 3 | — | (II-5) 300 mg | 110 | 6 | 9 | 645 | 0.04 |
| 4 | — | (II-5) 500 mg | 120 | 8 | 11 | 645 | 0.04 |
| 5 | (I-10) 300 mg | (II-5) 200 mg | 150 | 22 | 18 | 640 | 0.03 |
| 6 | (I-10) 200 mg | (II-5) 300 mg | 160 | 21 | 22 | 642 | 0.04 |
| 7 | (I-1) 300 mg | — | 110 | 7 | 3 | 632 | 0.03 |
| 8 | (I-1) 500 mg | — | 115 | 8 | 6 | 632 | 0.03 |
| 9 | — | (II-2) 300 mg | 115 | 6 | 13 | 643 | 0.03 |
| 10 | — | (II-2) 500 mg | 140 | 10 | 14 | 643 | 0.03 |
| 11 | (I-1) 300 mg | (II-2) 200 mg | 150 | 17 | 16 | 635 | 0.03 |
| 12 | (I-1) 200 mg | (II-2) 300 mg | 160 | 13 | 20 | 635 | 0.03 |
| 13 | (I-3) 300 mg | — | 105 | 8 | 6 | 630 | 0.03 |
| 14 | (I-3) 500 mg | — | 110 | 9 | 7 | 630 | 0.04 |
| 15 | — | (II-12) 300 mg | 120 | 10 | 9 | 650 | 0.04 |
| 16 | — | (II-12) 500 mg | 115 | 7 | 12 | 650 | 0.04 |
| 17 | (I-3) 300 mg | (II-12) 200 mg | 145 | 14 | 15 | 640 | 0.03 |
| 18 | (I-3) 200 mg | (II-12) 300 mg | 140 | 12 | 17 | 645 | 0.04 |
| 19 | (I-2) 300 mg | — | 115 | 12 | 11 | 635 | 0.05 |
| 20 | (I-2) 500 mg | — | 125 | 14 | 12 | 635 | 0.05 |
| 21 | — | (II-9) 300 mg | 130 | 11 | 12 | 645 | 0.03 |
| 22 | — | (II-9) 500 mg | 150 | 16 | 13 | 645 | 0.03 |
| 23 | (I-2) 300 mg | (II-9) 200 mg | 170 | 23 | 20 | 640 | 0.04 |
| 24 | (I-2) 200 mg | (II-9) 300 mg | 160 | 25 | 26 | 645 | 0.04 |

From Table 1, it is understood that the samples according to the present invention, which contain the combination of the compounds of the general formulas (I) and (II), are far more increased in spectral sensitivity than in the case where the said compounds are used independently, have excellent spectral sensitivity over the whole range of visible spectral region, and are excellent also in other photographic properties.

EXAMPLE 2

Samples were prepared and processed in the same manner as in Example 1, and then examined in resolving power to obtain such results as shown in Table 2. As the resolving power test chart, there was used a test chart.

Table 2

| Sample No. | Compound and amount mg/mole silver halide Compound (I) | Compound (II) | Resolving power (white light) Lines/mm |
|---|---|---|---|
| 25 | (I-3) 300 mg | — | 200 |
| 26 | (I-3) 500 mg | — | 210 |
| 27 | — | (II-12) 300 mg | 190 |
| 28 | — | (II-12) 500 | 200 |
| 29 | (I-3) 200 mg | (II-12) 300 mg | 230 |
| 30 | (I-3) 300 mg | (II-12) 200 mg | 250 |
| 31 | (I-4) 300 mg | — | 200 |
| 32 | (I-4) 500 mg | — | 205 |
| 33 | — | (II-7) 300 mg | 180 |
| 34 | — | (II-7) 500 mg | 200 |
| 35 | (I-4) 200 mg | (II-7) 300 mg | 240 |
| 36 | (I-4) 300 mg | (II-7) 200 mg | 230 |

From Table 2, it is understood that by the combination use of the compounds of the general formula (I) and (II), there are obtained excellent effects in resolving power which cannot be attained when the compounds are used independently.

In this example, it was also confirmed that the samples according to the present invention were excellent in spectral sensitivity and other photographic properties.

EXAMPLE 3

Using the combination of the compound (I-3) with the compound (II-6), an emulsion was prepared in the same manner as in Example 1. For comparision, another emulsion was prepared in the same manner as above, except that the compound (I-3) was replaced by the below-mentioned compound (A) similar in structure thereto and the compound (II-6) was replaced by the below-mentioned compound silimar in structure thereto. Both the compounds (A) and (B) are compounds out of the scope of the present invention.

Compound (A)

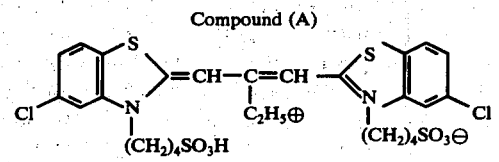

-continued

Compound (B)

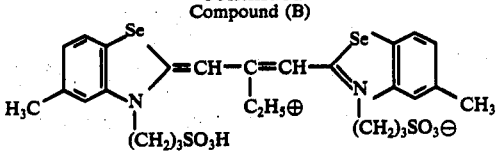

These emulsions were individually coated on the same film base as in Example 1 and then dried to prepare samples. The thus prepared samples were processed in the same manner as in Example 1 and measured in relative speed, sensitivity maximum and resolving power. The results obtained were as shown in Table 3.

General formula (I)

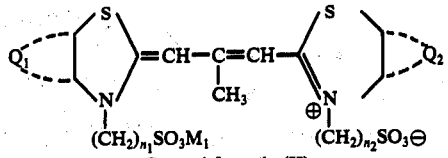

General formula (II)

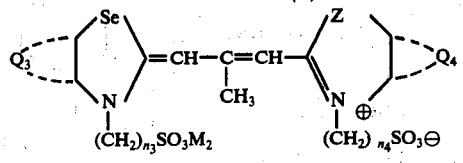

Table 3

| Sample No. | Compound and amount (mg/mole silver halide) | | | Relative speed White light speed | Green light speed | Red light speed | Sensitivity maximum (nm) | Fog | Resolving power Lines/mm |
|---|---|---|---|---|---|---|---|---|---|
| 37 | (I-3) 300 mg | | — | 105 | 8 | 6 | 630 | 0.03 | 200 |
| 38 | (I-3) 500 mg | | — | 110 | 9 | 7 | 630 | 0.04 | 210 |
| 39 | — | (B) | 300 mg | 115 | 6 | 8 | 650 | 0.04 | 190 |
| 40 | — | (B) | 500 mg | 120 | 7 | | 650 | 0.04 | 200 |
| 41 | (I-3) 200 mg | (B) | 300 mg | 125 | 8 | 10 | 640 | 0.04 | 200 |
| 42 | (I-3) 300 mg | (B) | 200 mg | 135 | 10 | 11 | 635 | 0.04 | 205 |
| 43 | (A) 300 mg | | — | 100 | 7 | 5 | 640 | 0.03 | 200 |
| 44 | (A) 500 mg | | — | 110 | 8 | 6 | 640 | 0.03 | 210 |
| 45 | — | (II-6) | 300 mg | 95 | 6 | 9 | 645 | 0.03 | 195 |
| 46 | — | (II-6) | 500 mg | 110 | 7 | 10 | 645 | 0.04 | 210 |
| 47 | (A) 200 mg | (II-6) | 300 mg | 125 | 9 | 12 | 643 | 0.03 | 210 |
| 48 | (A) 300 mg | (II-6) | 200 mg | 130 | 10 | 12 | 640 | 0.03 | 200 |
| 49 | (A) 200 mg | (B) | 300 mg | 130 | 9 | 12 | 640 | 0.03 | 200 |
| 50 | (A) 300 mg | (B) | 200 mg | 125 | 9 | 11 | 640 | 0.03 | 205 |
| 51 | (I-3) 200 mg | (II-6) | 300 mg | 145 | 20 | 18 | 643 | 0.03 | 230 |
| 52 | (I-3) 300 mg | (II-6) | 200 mg | 150 | 19 | 19 | 640 | 0.03 | 240 |

From Tables 3, it is understood that when two compounds according to the present invention are used in combination, a marked improvement in photographic properties can be observed as compared with the case where a compound similar in structure to the compounds of the present invention is used. That is, if either one of the compounds used in combination is replaced by a compound out of the scope of the present invention, such excellent effects as in the present invention cannot be obtained any more. Further, if the two compounds used in combination are compounds out of the scope of the present invention, no such effects as in the present invention can, of course, be obtained.

What we claim is:

1. A light-sensitive silver halide photographic material comprising a silver halide emulsion containing a compound having the below-mentioned general formula (I) and a compound having the below-mentioned general formula (II), wherein $Q_1$, $Q_2$, $Q_3$ and $Q_4$ are individually a non-metal atom grouping necessary to complete an unsubstituted or alkyl-, alkoxyl-, phenyl-, hydroxyl-, carboxyl- or halogen-substituted benzene ring, or a non-metal atom grouping necessary to complete a naphthalene ring; Z is a sulfur or selenium atom; $n_1$, $n_2$ $n_3$ and $n_4$ are individually 2, 3 or 4; and $M_1$ and $M_2$ are individually a hydrogen atom, an alkali metal atom or H-Q (where Q is an organic base).

2. A light-sensitive silver halide photographic material as claimed in claim 1, wherein the compound of the general formula (I) and the compound of the general formula (II) are used in the combined about of 100 -1000 mg. per mole of silver halide in said silver halide emulsion.

3. A light-sensitive silver halide photographic material as claimed in claim 1, wherein the compound of the general formula (I) is a compound selected from the group consisting of

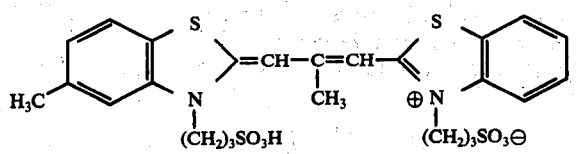

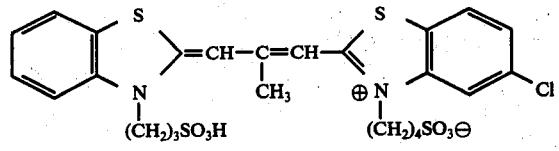

-continued
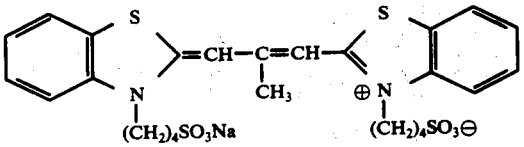
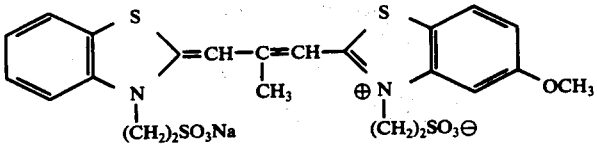
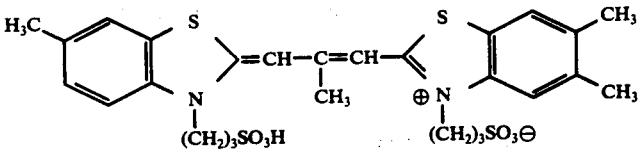
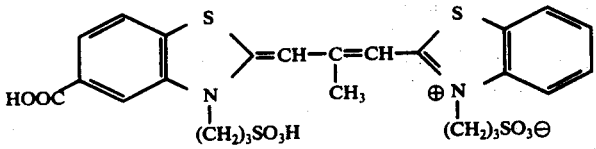
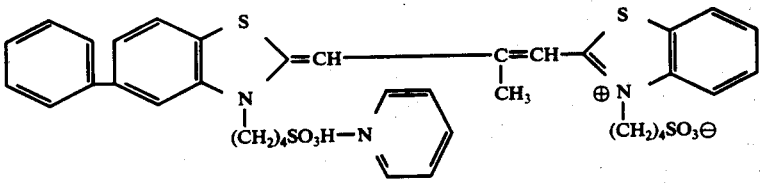
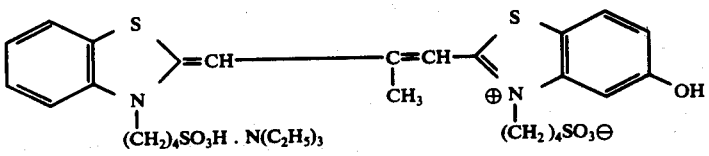
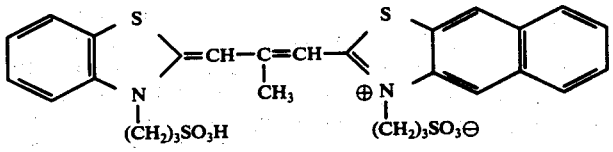
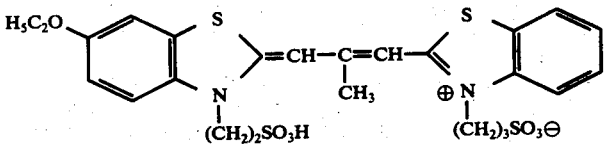
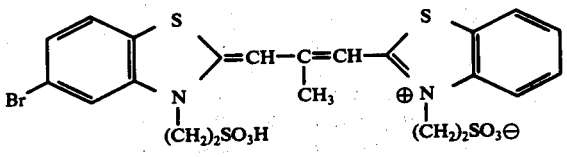
4. A light-sensitive silver halide photographic material as claimed in claim 1, wherein the compound of the general formula II is a compound selected from the group consisting of
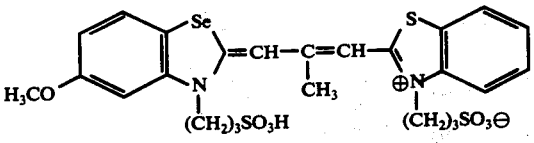
-continued
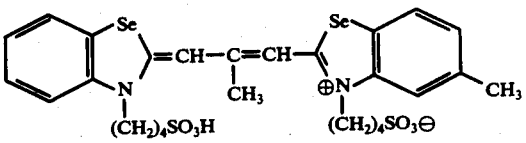
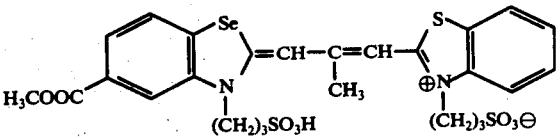

-continued

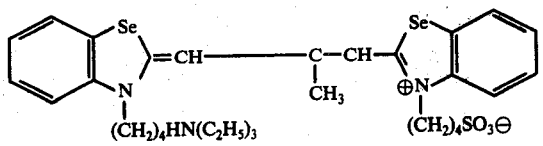

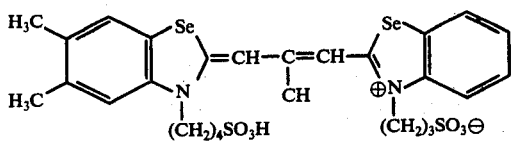

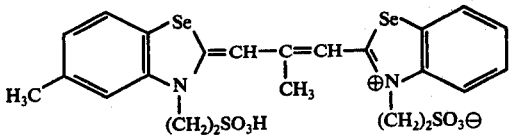

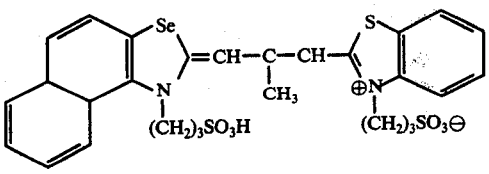

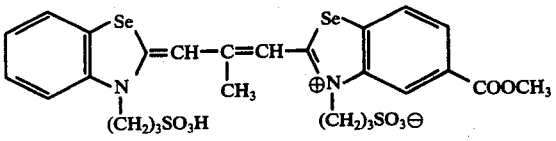

-continued

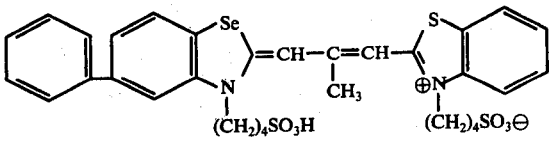

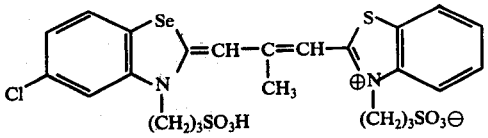

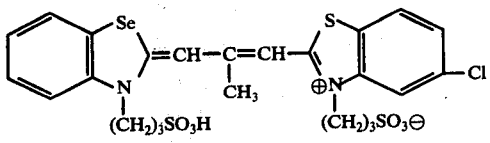

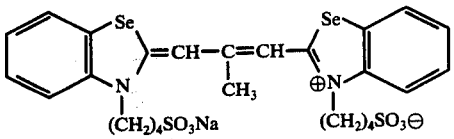

5. A light-sensitive silver halide photographic material as claimed in claim 1, wherein the compound of the general formula (I) and the compound of the general formula (II) are introduced separately or in combination as an aqueous solution or a water-miscible organic solvent solution or an aqueous water-miscible organic solvent solution into a silver halide emulsion before it is coated and particularly just after second ripening.

* * * * *